US007893620B2

(12) United States Patent
Lewis

(10) Patent No.: US 7,893,620 B2
(45) Date of Patent: Feb. 22, 2011

(54) TRAVELING-WAVE TUBE TURN-OFF BODY ENERGY CIRCUIT

(75) Inventor: David Eric Lewis, Torrance, CA (US)

(73) Assignee: L-3 Communications Electron Technologies, Inc., Torrance, CA (US)

( * ) Notice: Subject to any disclaimer, the term of this patent is extended or adjusted under 35 U.S.C. 154(b) by 1035 days.

(21) Appl. No.: 11/642,807

(22) Filed: Dec. 20, 2006

(65) Prior Publication Data

US 2008/0150629 A1 Jun. 26, 2008

(51) Int. Cl.
*H01J 25/34* (2006.01)
*H01J 29/96* (2006.01)

(52) U.S. Cl. ..... 315/3.5; 315/3

(58) Field of Classification Search ..... 315/3.5, 315/3.6, 5.14, 5.38
See application file for complete search history.

(56) References Cited

U.S. PATENT DOCUMENTS 3,890,545 A 6/1975 Rosen ..... 317/51
3,903,450 A * 9/1975 Forbess et al. ..... 315/382
4,323,853 A 4/1982 Kurokawa ..... 330/43
5,942,852 A * 8/1999 Goebel et al. ..... 315/3.5
6,111,358 A * 8/2000 Cardwell et al. ..... 315/3.5
6,262,536 B1 * 7/2001 Symons ..... 315/3
6,489,842 B2 * 12/2002 Eng ..... 330/43
7,579,778 B2 * 8/2009 Vaszari et al. ..... 315/3.5

* cited by examiner

*Primary Examiner*—Douglas W Owens
*Assistant Examiner*—Minh D A
(74) *Attorney, Agent, or Firm*—Proskauer Rose LLP

(57) ABSTRACT

An apparatus that includes a traveling-wave tube having an electron gun having a cathode. The apparatus also includes a first power supply for establishing a first electric potential between the cathode and an anode and for providing an operational current to the cathode to generate a beam of electrons. The apparatus also includes a slow-wave structure having a passage through which the beam of electrons passes. The apparatus also includes a second power supply for providing a voltage to a beam focusing electrode to establish an electric potential between the cathode and the beam focusing electrode. The apparatus also includes a switching module coupled to the first power supply and the second power supply, the switching module providing a current path between the cathode and the beam focusing electrode, wherein the current path is disabled when a biasing current is below a predetermined level.

15 Claims, 4 Drawing Sheets

TRAVELING-WAVE TUBE TURN-OFF BODY ENERGY CIRCUIT

FIELD OF THE INVENTION

The invention relates to traveling-wave tube systems and more particularly to systems and methods for protecting traveling-wave tube systems when power to the traveling-wave tube cathode is turned off.

BACKGROUND OF THE INVENTION

Traveling-wave tubes are capable of amplifying and generating microwave signals over a considerable frequency range (e.g., 1-90 GHz) with relatively high output powers (e.g., >10 megawatts), relatively large signal gains (e.g., 60 dB), and over relatively broad bandwidths (e.g., >10%).

In a traveling-wave tube, an electron gun generates a beam of electrons that are directed through a slow-wave structure and collected by a collector. The electron gun generates the beam of electrons by creating an electrical potential between a cathode and an anode. Electrons emitted from the cathode are accelerated towards the anode by the electrical potential between the anode and cathode. The slow-wave structure generally comprises either a helical conductor or a coupled cavity circuit with signal input and output ports located at opposite ends of the structure. The electron beam is directed into an opening of the slow-wave structure, through the slow-wave structure, and out another opening in the slow-wave structure. A beam-focusing structure surrounding the slow-wave structure creates an axial magnetic field that contains the electron beam within the slow-wave structure.

A microwave signal applied to one of the ports propagates along the slow-wave structure to the other port at a projected axial velocity that is considerably less than the free space speed of light. With the velocity of the electron beam adjusted to be similar to the projected axial velocity of the microwave signal propagating along the slow-wave structure, the fields of the microwave signal and electron beam interact with one another so as to transfer energy from the electron beam to the microwave signal, thereby amplifying the microwave signal.

A traveling-wave tube may be used as an amplifier by coupling a microwave signal to the signal input port of the slow-wave structure. The microwave signal propagates towards the signal output port in the same direction as the electron beam and becomes amplified by extracting energy from the electron beam. As a result of this energy exchange, the electron beam loses energy which reduces the velocity of the electron beam.

During operation, the power supply of a traveling-wave tube system stores a large amount of energy. When the traveling-wave tube system is turned off, the system must dissipate the energy without damaging components of the traveling-wave tube system. This problem is more difficult as newer traveling-wave tube systems are developed that require greater amounts of energy to operate. In addition, traveling-wave tube systems that employ components using more delicate structures (e.g., helical structures fabricated using fine gage wires) are more prone to damage when the traveling-wave tube system is turned off and the energy stored in the system must be dissipated.

A need therefore exists for systems and methods for providing traveling-wave tube systems that dissipate energy stored in the system in a manner that minimizes the risk that components of the system will be damaged.

SUMMARY OF THE INVENTION

The invention, in one aspect, features a traveling-wave tube system that safeguards components of a traveling-wave tube when the system is turned off. More particularly, in one embodiment, the invention features a system for disabling the current path between a cathode and a beam focusing electrode under certain operating conditions. The current path is disabled when the system is turned off in order to protect the traveling-wave tube (e.g., the slow-wave structure) by minimizing the amount of energy discharged by the cathode and/or electronic power conditioner into the traveling-wave tube.

The invention, in one aspect, features an apparatus that includes a traveling-wave tube having an electron gun having a cathode. The apparatus also includes a first power supply for establishing a first electric potential between the cathode and an anode and for providing an operational current to the cathode to generate a beam of electrons. The apparatus also includes a slow-wave structure having a passage through which the beam of electrons passes. The apparatus also includes a second power supply for providing a voltage to a beam focusing electrode to establish an electric potential between the cathode and the beam focusing electrode. The apparatus also includes a switching module that is coupled to the first power supply and the second power supply. The switching module provides a current path between the cathode and the beam focusing electrode, and the current path is disabled when a biasing current is below a predetermined level. In some embodiments, a single power supply is used that includes circuitry that incorporates the functionality of both the first power supply and second power supply.

The invention, in another aspect, relates to a method for operating a traveling-wave tube system. The method involves connecting a switching module to at least one power supply that supplies a first voltage to a cathode and a second voltage to a beam focusing electrode. An operating current flowing to the cathode provides a biasing current to the switching module that establishes a current path between the cathode and the beam focusing electrode. The method also involves disabling (e.g., by manipulating the switch module) the current path between the cathode and the beam focusing electrode when the biasing current is reduced below a predetermined level.

In some embodiments, the at least one power supply comprises a first power supply for supplying the first voltage to the cathode and a second power supply for supplying the second voltage to the beam focusing electrode. In some embodiments, the current path becomes disabled in response to the power supply being turned off. In some embodiments, the switching module prevents energy stored at the cathode from discharging into the slow-wave structure when the current path is disabled. In some embodiments, the switching module re-directs energy stored in the cathode from discharging in the traveling-wave tube to discharge in at least one electrical component (e.g., resistor) located in the power supply when the current path is disabled.

In some embodiments, the method involves establishing a potential difference between the first voltage and the second voltage when the current path is disabled. In some embodiments, the method involves terminating a current flowing to the cathode when a difference between the first voltage and the second voltage exceeds a threshold voltage level characteristic of the traveling-wave tube. In some embodiments, the method involves terminating a current flowing to the cathode when the first voltage exceeds a first threshold voltage level and the second voltage exceeds a second threshold voltage level. In some embodiments, the method involves controlling the second voltage with a circuit element in the switching module to prevent the second voltage from exceeding the first voltage by more than a predetermined amount when the current path is disabled. In some embodiments, the method involves disabling a current path between the cathode and the beam focusing electrode when the operational current flowing to the cathode is below a predetermined level.

The invention, in another aspect, features a circuit that includes a switching module. The switching module is coupled to at least one power supply for supplying an operating current to a cathode. The operating current includes a biasing current to establish a current path between the cathode and a beam focusing electrode, wherein the current path is disabled when the biasing current is below a predetermined level.

In some embodiments, energy stored at the cathode is prevented from discharging into a slow-wave structure of a traveling-wave tube when the current path is disabled. In some embodiments, the at least one power supply includes a first power supply to establish a first electric potential between the cathode and an anode, and a second power supply to establish a second electric potential between the cathode and the focusing electrode. In some embodiments, the second power supply stops providing current to the beam focusing electrode in response to the current path being disabled. In some embodiments, the cathode operational current terminates in response to the current path being disabled.

The cathode operational current can be terminated when a difference between the first voltage and the second voltage exceeds a threshold voltage level. In some embodiments, the traveling-wave tube cathode current is terminated when the first voltage exceeds a first threshold voltage level and the second voltage exceeds a second threshold voltage level. The power supply can be a high-frequency switch mode or resonant power supply.

The invention, in another aspect, features a traveling-wave tube system. The system includes a traveling-wave tube that includes an electron gun having a cathode. The system also includes a switching module. The switching module has a first state that allows current to flow between the cathode and a beam focusing electrode when a power supply provides a first voltage to the cathode and a second voltage to the beam focusing electrode. The switching module also has a second state that prevents current from flowing between the cathode and the beam focusing electrode when the power supply no longer provides the first voltage to the cathode.

In some embodiments, when operating in the second state, voltage between the cathode and beam focusing electrode is limited by a circuit element or voltage clamp. In some embodiments, voltage between the cathode and the beam focusing electrode is limited by a voltage clamp that enables some current to bypass the switching module.

The invention, in another aspect, features a traveling-wave tube system. The system includes a traveling-wave tube that includes an electron gun having a cathode for generating a beam of electrons. The system also includes a means for controlling a current path between the cathode and a beam focusing electrode such that the current path is established when an operating current provided by a power supply to the cathode includes a biasing current (provided by the cathode to the beam focusing electrode) above a predetermined level and the current path is disabled when the biasing current is below a predetermined level.

The foregoing and other objects, aspects, features, and advantages of the invention will become more apparent from the following description and from the claims.

BRIEF DESCRIPTION OF THE DRAWINGS

The foregoing and other objects, features and advantages of the invention, as well as the invention itself, will be more fully understood from the following illustrative description, when read together with the accompanying drawings which are not necessarily to scale.

DETAILED DESCRIPTION OF ILLUSTRATIVE EMBODIMENTS

Figure 1:
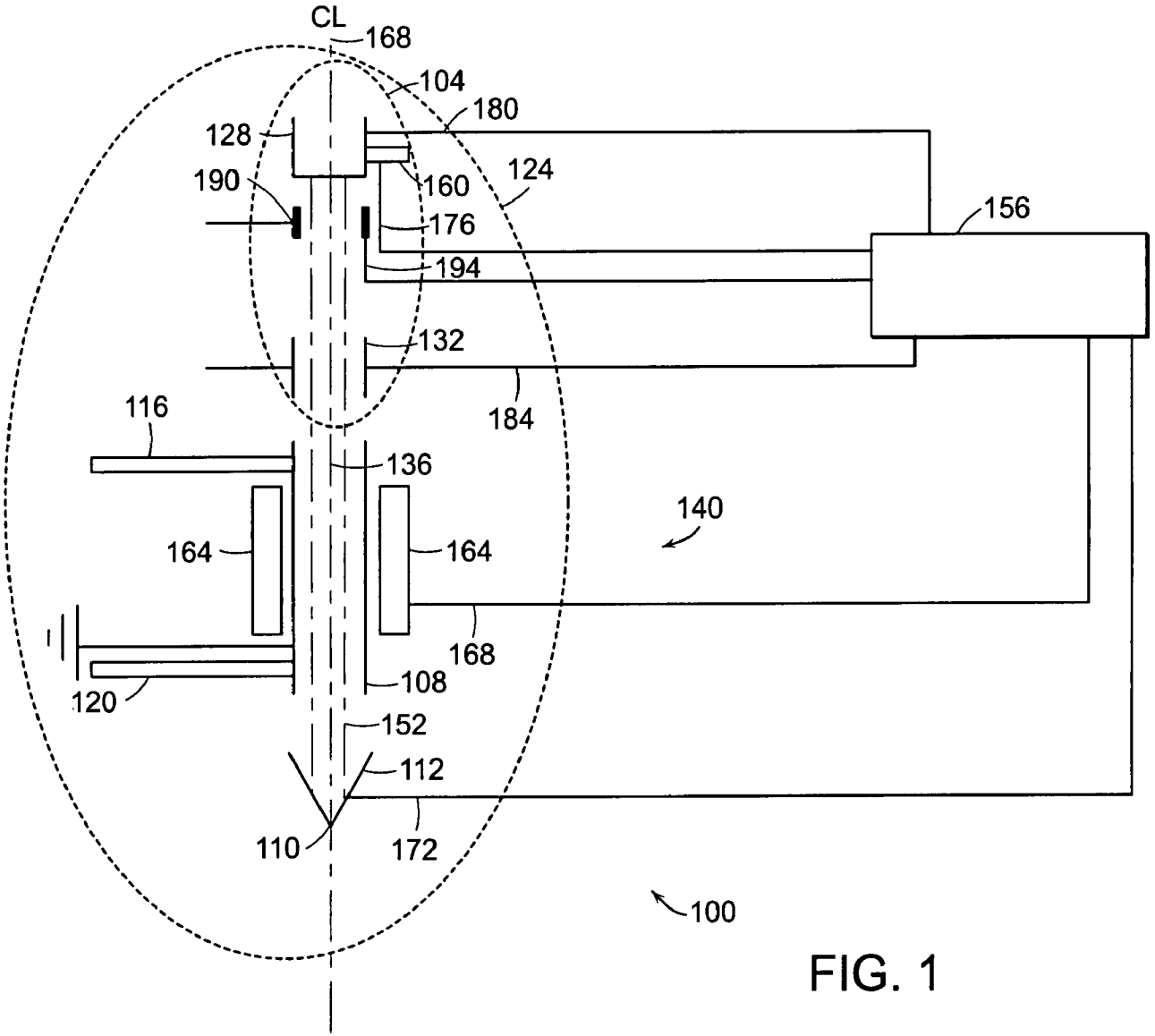
FIG. 1 is a schematic illustration of a traveling-wave tube system, according to an illustrative embodiment of the invention.

FIG. 1 is a schematic illustration of a traveling-wave tube system 100, incorporating principles of the invention. The system 100 includes a traveling-wave tube 124, an electron gun 104, a slow-wave structure 108 and a collector 110 having at least one collector electrode 112. The system 100 also includes an electronic power conditioner 156 for providing energy to the traveling-wave tube 124 and components thereof. The slow-wave structure 108 includes a signal input port 116 and a signal output port 120. Typically, a housing (not shown) encloses and protects the components of the traveling-wave tube 124.

The electron gun 104 includes a cathode 128 and an anode 132. In operation, an electric potential is applied between the cathode 128 and the anode 132 by the electronic power conditioner 156. The electronic power conditioner 156 has a plurality of outputs. The outputs of the electronic power conditioner 156 include connection 180 and connection 184. The electronic power conditioner 156 establishes the electric potential by establishing an electric potential between connection 180 which is coupled to the cathode 128 and connection 184 which is coupled to the anode 132 (which is electrically isolated from the cathode 128).

The cathode 128 generates and emits a beam of electrons 152 in response to the applied electric potential. In one embodiment, a potential of greater than several thousand volts is generally applied between the cathode 128 and the anode 132 to generate the beam of electrons 152. The cathode 128 is set at a large negative voltage relative to the anode 132 to generate the beam of electrons 152. In some embodiments, an optional heater element 160 is used to heat the cathode 128 to initiate and/or maintain a flow of electrons emitted from the cathode 128 to produce the beam of electrons 152. The electronic power conditioner 156 provides energy to the heater element 160 via connection 176 to cause the heater element 160 to heat the cathode 128.

In some embodiments, the heater element 160 is necessary in order to heat the cathode 128 up to a proper temperature before applying the high voltage to the cathode 128 and to maintain the temperature during operation. In some embodiments, the traveling-wave tube system 100 does not operate properly or can be catastrophically damaged if a high voltage is applied to the cathode 128 when the cathode 128 is not warmed up to a proper temperature.

The slow-wave structure 108 is located adjacent the electron gun 104 such that the beam of electrons 152 passes through a passage 136 in the slow-wave structure 108. The slow-wave structure 108 generally includes a helical structure or a coupled cavity circuit. In operation, a microwave signal is introduced to the slow-wave structure 108 via the input port 116 of the slow-wave structure 108. The microwave signal propagates along the slow-wave structure 108 at an axial velocity that is substantially less than the speed of light. The axial velocity is a function of, for example, the electrical and geometrical properties of the slow-wave structure 108. The ratio of the axial velocity to the free-space velocity is often referred to as the velocity factor of the slow-wave structure 108.

The velocity factor of the slow-wave structure 108 and the electrical potential between the cathode 128 and the anode 132 are chosen so that the electric fields of the microwave signal interact with the beam of electrons 152 in the slow-wave structure 108. The interaction between the microwave signal and the beam of electrons 152 results in velocity modulation of the beam of electrons 152 and energy is transferred from the beam of electrons 152 to the microwave signal, thereby amplifying the microwave signal while slowing the velocity of the electrons in the beam of electrons 152. The amplified microwave signal exits the output port 120 of the slow-wave structure 108. The electrons in the beam of electrons 152 that pass through the passage 136 of the slow-wave structure 108 are collected by the collector electrode 112 of the collector 110. The collector 110 is maintained at a negative DC voltage, for example, −11 kV in one embodiment. The electronic power conditioner 156 provides the DC voltage to the collector 110 via connection 172. Alternative DC voltage magnitudes can be applied to the collector 110.

By way of example, the microwave signal introduced to the input port 116 initially travels close to the speed of light and must be slowed down to the speed of the beam of electrons 152 which travel at about 10% to about 50% of the speed of light. In a slow-wave structure 108 incorporating a helix structure, the microwave signal travels along the generally circular/spiral path of the helix. The beam of electrons 152 travels a distance of about one pitch of the helical structure which is a smaller distance than one revolution of the circular path of the helical structure. In this manner, the speed of the microwave signal is reduced to approximately the speed of the beam of electrons 152 so energy can be transferred from the beam of electrons 152 to the microwave signal while they interact with each other.

A coupled cavity circuit (or structure) may, alternatively, be used in the slow-wave structure 108. In a coupled cavity circuit, the microwave signal travels along the inner surfaces of the cavities of the coupled-cavity circuit while the beam of electrons 152 passes through openings between adjacent cavities. The microwave signal travels over a larger distance than the beam of electrons 152, thereby slowing the microwave signal relative to the beam of electrons 152.

The traveling-wave tube system 100 also includes a beam focusing structure 164 that is generally positioned coaxial with and surrounding at least a portion of the slow-wave structure 108. The beam focusing structure 164 creates an axial magnetic field along the traveling-wave tube axis 168 that acts in a direction normal to the direction of travel of the beam of electrons 152. The axial magnetic field acts on the system 100 to cause the electrons in the beam of electrons 152 to be contained in the slow-wave structure 108 in such a manner that the beam of electrons 152 maintains a tight path. In the absence of one or more beam focusing structures 164, the electrons in the beam of electrons 152 would tend to repel each other causing the beam of electrons 152 to diverge.

The beam focusing structure 164 can be, for example, a current carrying solenoid. In this embodiment, the electronic power conditioner 156 provides a flow of current to the coil of the solenoid of the beam focusing structure 164 via connection 168. The flow of current in the coil induces the axial magnetic field that acts on the beam of electrons 152. In some embodiments, the beam focusing structure 164 includes a stack of permanent magnets and does not require a flow of current from the electronic power conditioner 156 to create a magnetic field to act on the beam of electrons 152.

Traveling-wave tubes sometimes also include a second anode (not shown) located between the cathode 128 and the slow-wave structure 108 which is used as an ion trap. During operation, the beam of electrons 152 ionizes residual gas molecules in he traveling-wave tube 124. The ions produced drift towards the electron gun 104 and are accelerated towards the cathode 128 where they contaminate the cathode 128 and interfere with operation of the system. The ion trap is used to repel the ions generated to prevent the ions from bombarding the cathode 128, thus preventing premature aging of the cathode 128 and/or reduction in system performance.

In some embodiments, the anode 132 is used as the ion trap and also establishes the electric potential between the anode 132 and the cathode 128 to generate the beam of electrons 152. The electronic power conditioner 156 applies a low voltage (e.g., 0 V or ground) relative to the cathode 128 to establish the electric potential between the cathode 132 and the anode 128. In order for the anode to operate as an ion trap, the electronic power conditioner 156 applies a low, positive voltage (e.g., +200 volts) to the anode 132. The +200 volt electric potential applied to the anode 132 repels ions generated in the slow-wave structure 108 from the anode 132. The ions are positively charged molecules formed by the interaction of the beam of electrons 152 with residual gas molecules in the slow-wave structure 108. Because the anode 132 is maintained at a positive voltage (e.g., +200 volts in one embodiment) and the ions are positively charged, the anode 132 acts as an electrical barrier that prevents the ions from traveling towards the cathode 128 (which has a large negative electrical voltage potential relative to the positively charged ions).

In some embodiments, the traveling-wave tube system 100 includes a plurality of collector electrodes, each at a different electric potential relative to the body (e.g., housing) of the traveling-wave tube 124 to collect electrons of different electric potential levels. In some embodiments, the traveling-wave tube system 100 incorporates a vacuum ion pump to collect ions generated.

In some embodiments the traveling-wave tube system 100 includes a beam focus electrode 190 located in close proximity to the cathode 128. The focus electrode 190 controls the shape of the accelerating electric field of the beam of electrons 152 in a region close to the cathode 128, which provides an improved electron beam emission from the cathode 128, that is easier to maintain focus and confinement of the beam of electrons 152 within the slow wave structure 108. The focus electrode 190 is biased by a voltage signal provided to the focus electrode 190 from the electronic power conditioner 156 via connection 194. The focus electrode 190 is biased to a low negative voltage with respect to the cathode 128. In one embodiment, the focus electrode is biased to between about −5 volts to about −20 volts. In addition to improving beam focusing, by biasing the focus electrode 190 with respect to the cathode 128 to a sufficiently high negative potential (e.g., −500 volts in one embodiment), the traveling wave tube electron beam can be turned off. This is a useful property of the focus electrode 190 that is often employed in controlling the on/off state of the beam of electrons 152.

Figure 2:
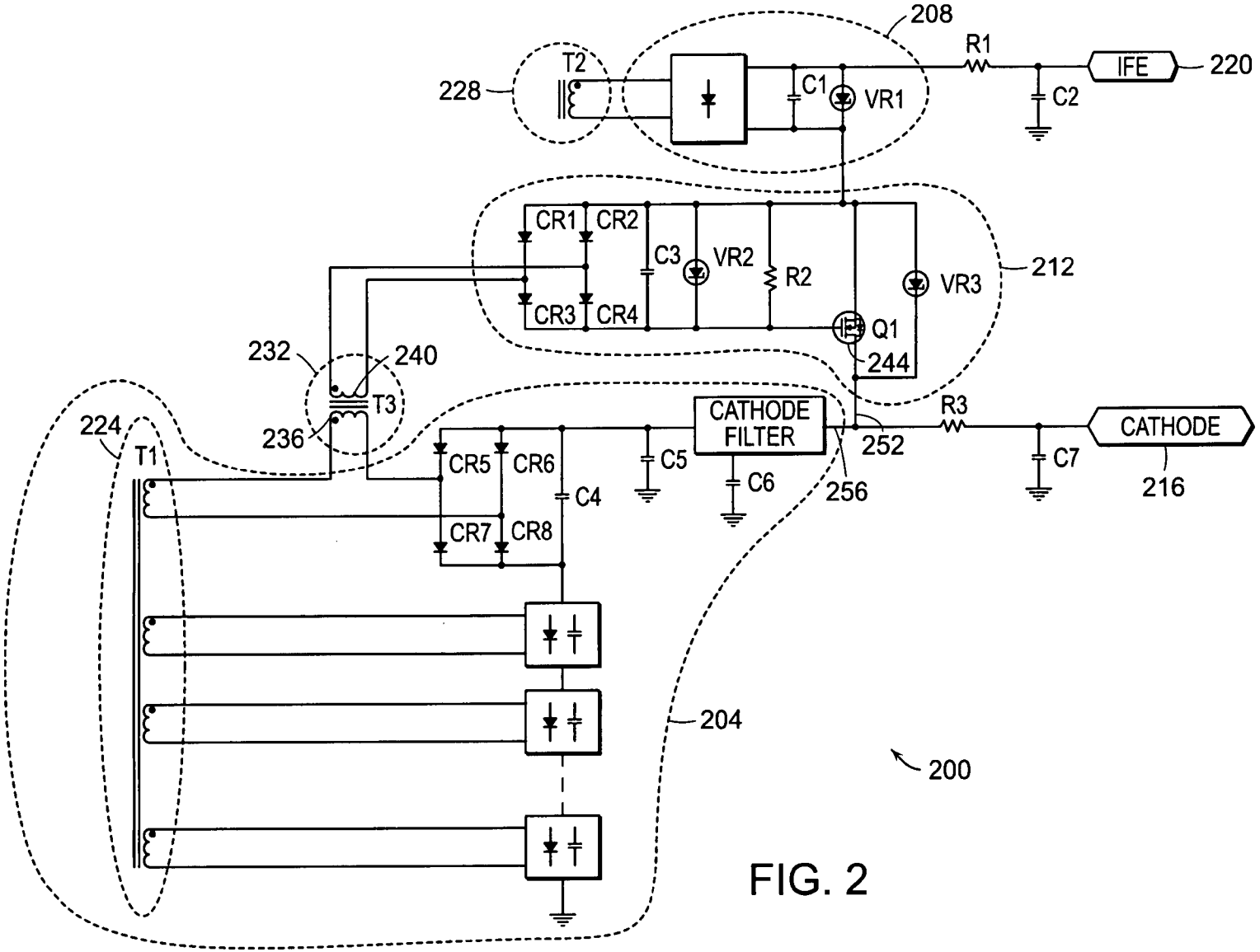
FIG. 2 is an illustration of a portion of an electrical schematic used in conjunction with a traveling-wave tube system, according to an illustrative embodiment of the invention.

FIG. 2 is an illustration of a portion of an electrical schematic of an electronic power conditioner 200, according to an illustrative embodiment of the invention. The electronic power conditioner 200 can be used in, for example, the traveling-wave tube system 100 of FIG. 1. (as the electronic power conditioner 156 of FIG. 1). The electronic power conditioner 200 includes a high voltage stage 204 for applying a large, negative DC voltage to the cathode (e.g., the cathode 128 of FIG. 1) of the traveling-wave tube system via connection 216. The high voltage stage 204 establishes an electric potential between the cathode and the anode of the traveling-wave tube system. In some embodiments, the high voltage stage is a high-frequency switch mode power supply stage or a resonant power supply stage.

The electronic power conditioner 200 also includes three transformers 224, 228 and 232. The first transformer 224 provides energy to the high voltage stage 204 to establish the large, negative DC voltage on the connector 216 that is coupled to the cathode of the traveling-wave tube system. The second transformer 228 provides energy to a heater element (not shown) that heats the cathode (e.g., the heater element 160 of FIG. 1 which heats the cathode 128). The second transformer 228 also provides a driving voltage to a focus electrode bias power supply 208. The focus electrode bias supply 208 provides a bias voltage to the traveling-wave tube focus electrode (e.g., focus electrode 190 of FIG. 1) via connection 220.

The primary circuit 236 of the third transformer 232 is coupled to the last winding of the first transformer 232 (i.e., the winding that processes the full cathode operational current). The secondary circuit 240 of the third transformer 232 is connected to a switching circuit or module 212. The switching module 212 includes a plurality of electrical components, for example, resistors, capacitors, diodes and MOSFET 244.

In operation, when an electric potential is established between the cathode and the anode of the traveling-wave tube system, the high voltage stage 204 provides an operational current to the cathode to generate the beam of electrons. In this mode, the switching module 212 is configured such that the cathode provides a biasing current to the switching module 212 via connection 252. The biasing current establishes a current path between the cathode, coupled to connection 216, and the focus electrode bias supply 208, coupled to the connection 220.

When the electronic power conditioner 200 is turned off, the high voltage transformer 224 stops working and the output 256 begins to discharge due to currents in the traveling-wave tube (e.g., between the cathode and collectors as well as the cathode and the slow-wave structure). The cathode voltage moves in the positive direction. In the absence of the functionality provided by the switching module 212, energy stored in the high voltage stage 204 would flow into the traveling-wave tube where it can damage, for example, the helical conductor of the traveling-wave tube.

Accordingly, the technology functions to limit or disable the flow of energy from the electronic power conditioner 200 and/or cathode in to the traveling-wave tube. In this embodiment, when the cathode current (e.g., current flowing through the primary circuit 236 of the third transformer 232) exceeds a threshold, the MOSFET 244 in the switching module 212 is turned on. In this embodiment, the threshold is determined based on the turns ratio of the third transformer 232 and values of electrical components in the switching module 212. In operation, when the cathode current drops below the threshold, the MOSFET 244 is turned off by the switching module 212.

In one embodiment, the threshold (the on/off threshold of the switching module 212) is set to a value of about 50% of the nominal cathode operational current. The nominal cathode operational current is determined based on, for example, the design of the cathode, anode, traveling-wave tube, electronic power conditioner and the desired signal propagation and amplification characteristics of the traveling-wave tube system and application in which it is being used (e.g., a telecommunications satellite system).

In the presence of the switching module 212, when the electronic power conditioner is turned off, the MOSFET 244 turns off (similarly as described herein). In this condition or state, any capacitance on the connection 220 (coupled to the focus electrode output) with respect to ground will act to try to maintain the voltage at the connection 220 at its nominal operating voltage. If the impedance of the switch 244 is high enough and the capacitance is high enough, the beam focus electrode will discharge at a slower rate than the electronic power conditioner 200 and the cathode. Exemplary impedances are between about 50 MΩ and 10 or more GΩ depending on device selection. Exemplary capacitances are between about 50 pico Farads and 3000 or more pico Farads.

This condition or state enables the cathode voltage to move positive with respect to the beam focus electrode which reduces the flow of current in the traveling-wave tube electron beam. As the cathode voltage continues its positive discharge, ultimately the voltage between the cathode and the focus electrode becomes large enough to completely terminate the electron beam current. After this occurs, the remaining energy stored in the cathode and electronic power conditioner 200 then slowly discharges in to, for example, electrical components (e.g., a resistor) in the electronic power conditioner 200. In this manner, energy dissipation in the traveling-wave tube or components thereof is minimized and represents a small fraction of the total energy stored in the electronic power conditioner 200.

Alternative systems and methods can be used to minimize energy discharge in to components of a traveling-wave tube, according to alternative embodiments of the invention. For example, an alternative switching module could be employed that responds to voltages or voltage differences in the traveling-wave tube system. Further, in some embodiments, more than one MOSFET 244 can be used in the electronic power conditioner 200. For example, in some embodiments, two MOSFETS 244 are included in the switching module 212 in series to reduce the voltage that would otherwise be applied across a single MOSFET.

Referring to FIG. 1, in one alternative embodiment, the electronic power conditioner 156 supplies a first voltage to the cathode 128 via connection 180 and a second voltage to the focus electrode 190. When the traveling-wave tube system 100 is operating, the beam of electrons 152 is flowing and the magnitudes of the first and second voltages are generally stable. When the traveling-wave tube system 100 is turned off, the magnitudes of the first and second voltages can change. In this manner, a switching module can be configured to disable the current path between the cathode 128 and the focus electrode bias supply (e.g., the focus electrode bias supply 208 of FIG. 2) connected to the focus electrode 190 to the change in magnitude of the first and second voltages (e.g., when the first voltage exceeds a first threshold and the second voltage exceeds a second threshold). The threshold levels can be based on one or more characteristics of the traveling-wave tube (e.g., voltage or current carrying capacity of the slow-wave structure). By way of example, the switching module can be, for example, MOSFETS and other electrical components that are located, for example, in the electronic power conditioner 156.

In some embodiments, the switching module can be configured to disable the current path between the cathode and the focus electrode bias supply 208 based on the magnitude (or change in magnitude) of the first voltage, second voltage or difference between the first and the second voltage. In one embodiment, by disabling the current path between the cathode and the focus electrode bias supply 208, the switching module prevents the second voltage from exceeding the first voltage by more than a predetermined amount when the current path is disabled when the traveling-wave tube system is turned off.

Figure 3A:
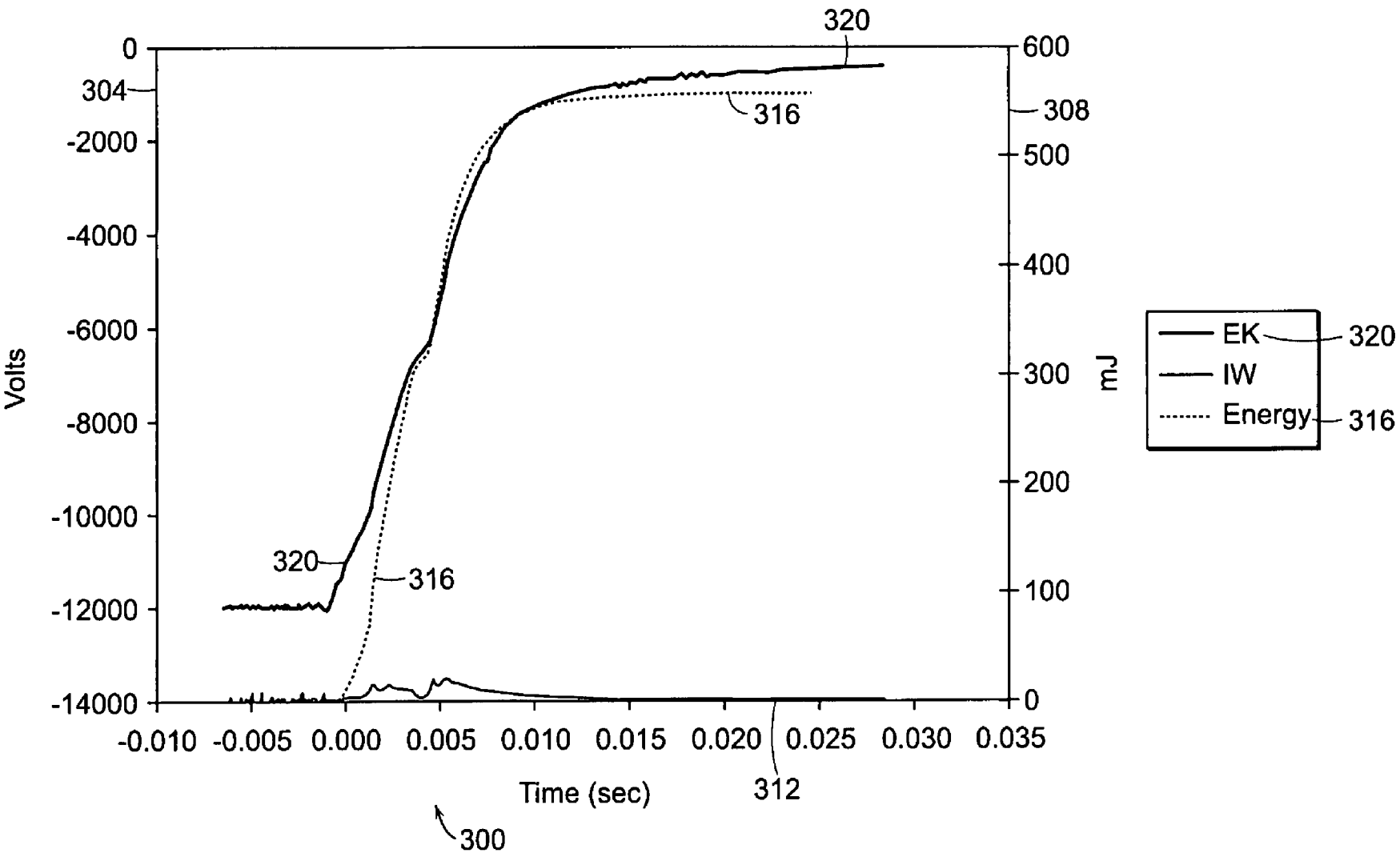
FIG. 3A is a graphical representation of energy discharge in a traveling-wave tube, not incorporating principles of the invention.

By way of illustration, an experiment was conducted to measure the amount of energy discharged in to a traveling-wave tube when the traveling-wave tube system was turned off. FIG. 3A is a graphical representation of a plot 300 of the energy discharge results obtained using the electronic power conditioner 200 of FIG. 2 without the switching module 212, in a traveling-wave tube system (e.g., the traveling-wave tube system 100 of FIG. 1). The left side Y-Axis 304 of the plot 300 is the voltage on the cathode (also the voltage on connection 216 of FIG. 2). The right side Y-Axis 308 of the plot 300 is the energy (in units of Joules) discharged in the traveling-wave tube. The TWT body current (current through the body of the traveling wave tube 124) was monitored with a current probe connected to an oscilloscope. The cathode voltage waveform along with the body current was captured as the electronic power conditioner 200 was turned off. The resulting oscilloscope traces were saved to a data file. Body energy was then calculated from these traces by integrating with respect to time the cathode voltage multiplied by the body current. The X-Axis 312 of the plot 300 is time (in units of seconds).

The traveling-wave tube system was turned off at about −0.001 seconds. FIG. 3A shows that the voltage on the cathode (curve 320) changes from about −12,000 volts at −0.001 seconds to about −700 volts at about 0.015 seconds. FIG. 3A also shows that the energy discharged into the traveling-wave tube (curve 316) increases from about 0 Joules at −0.001 seconds to about 550 mjoules at about 0.015 seconds.

Figure 3B:
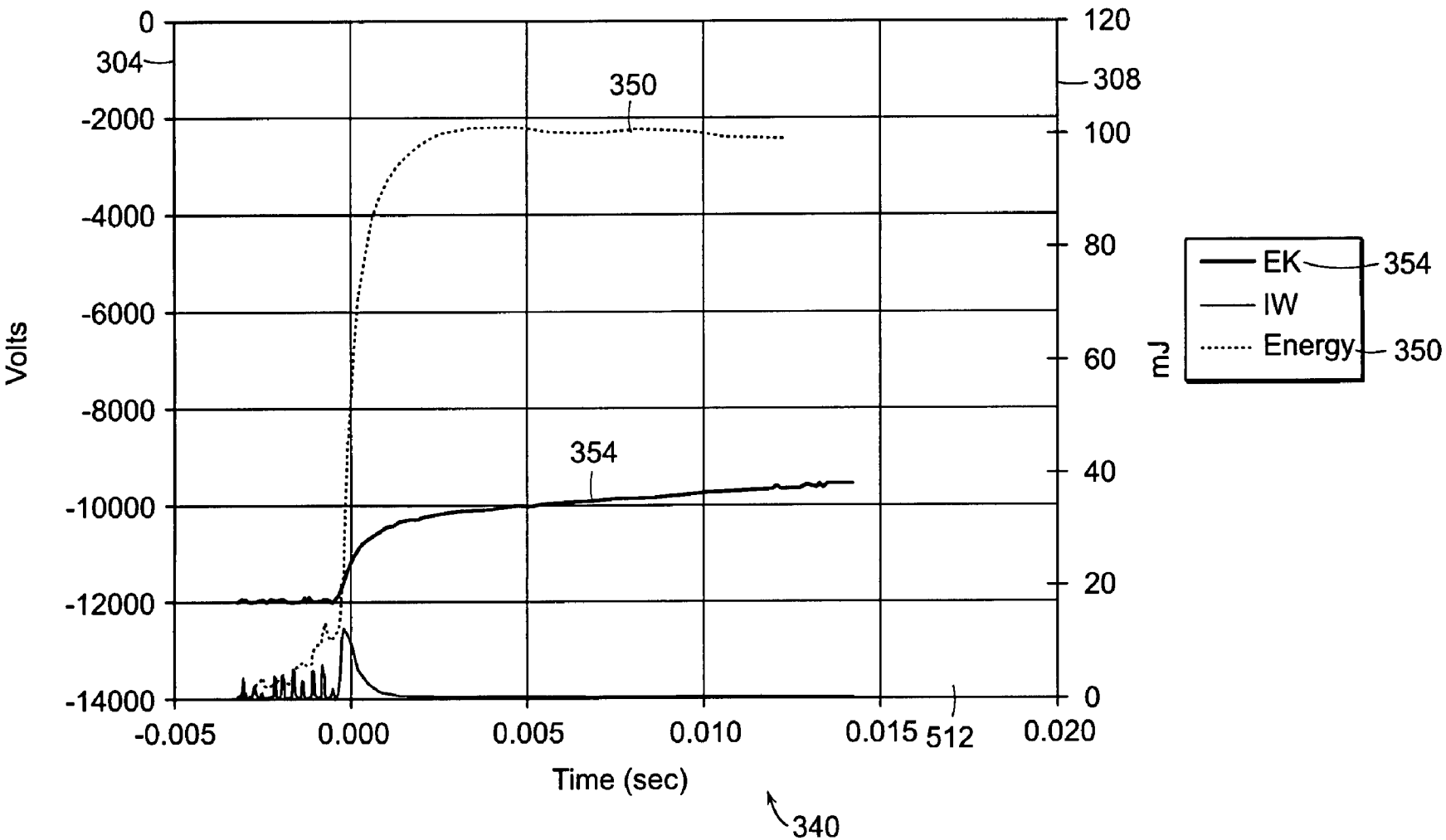
FIG. 3B is a graphical representation of energy discharge in a traveling-wave tube, incorporating principles of the invention.

FIG. 3B is a graphical representation of a plot 340 of the energy discharge results using the electronic power conditioner 200 of FIG. 2 with the switching module 212. The switching module 212 was configured to turn the MOSFET off when the cathode current drops below 50% of the nominal current (similarly as described herein). The nominal current in this embodiment was about X mA. The left side Y-Axis 304 of the plot 300 is the voltage on the cathode (also the voltage on connection 216 of FIG. 2). The right side Y-Axis 308 of the plot 300 is the energy (in units of Joules) discharged in the traveling-wave tube. The X-Axis 312 of the plot 300 is time (in units of seconds).

The traveling-wave tube system was turned off at about −0.001 seconds. FIG. 3B shows that the voltage on the cathode (curve 354) changes from about −12,000 volts at −0.001 seconds to about −10,000 volts at 0.005 seconds. FIG. 3B also shows that the energy discharged into the traveling-wave tube (curve 350) increases from about 18 mJoules at −0.001 seconds to about 100 mJoules at 0.005 seconds.

By comparison, the energy dissipated in the traveling-wave tube was about 5.5 times less in the system using a switching module 212, according to an illustrative embodiment of the invention (about 550 mjoules in FIG. 3A versus about 100 mjoules in FIG. 3B).

The energy dissipation requirements for traveling-wave tube systems become greater as, for example, the voltages applied to the cathode and the beam-focusing electrode become greater. The dissipation requirements become greater because the energy in the traveling-wave tube system increases by the square of the voltage in the system.

Variations, modifications, and other implementations of what is described herein will occur to those of ordinary skill in the art without departing from the spirit and the scope of the invention as claimed. Accordingly, the invention is to be defined not by the preceding illustrative description but instead by the spirit and scope of the following claims.

What is claimed is:

1. An apparatus comprising:

a traveling-wave tube including an electron gun having a cathode;

a first power supply for establishing a first electric potential between the cathode and an anode and for providing an operational current to the cathode to generate a beam of electrons;

a slow-wave structure having a passage through which the beam of electrons passes;

a second power supply for providing a voltage to a beam focusing electrode to establish an electric potential between the cathode and the beam focusing electrode; and a switching module coupled to the first power supply and the second power supply, the switching module providing a current path between the cathode and the beam focusing electrode, wherein the current path is disabled when the operating current or a biasing current between the cathode and the beam focusing electrode, is below a predetermined level.

2. A method comprising:

a) connecting a switching module to at least one power supply that supplies a first voltage to a cathode and a second voltage to a beam focusing electrode, wherein an operating current flowing to the cathode provides a biasing current to the switching module that establishes a current path between the cathode and the beam focusing electrode, and b) disabling the current path when the biasing current is reduced below a predetermined level, wherein the switching module prevents energy stored at the cathode from discharging into a slow-wave structure when the current path is disabled.

3. The method of claim 2, wherein the at least one power supply comprises a first power supply for supplying the first voltage to the cathode and a second power supply for supplying the second voltage to the beam focusing electrode.

4. The method of claim 2, wherein the current path becomes disabled in response to the power supply being turned off.

5. The method of claim 2, wherein the switching module re-directs energy stored in the cathode from discharging in the traveling-wave tube to discharge in at least one resistor located in the power supply when the current path is disabled.

6. The method of claim 2, further comprising establishing a potential difference between the first voltage and the second voltage when the current path is disabled.

7. The method of claim 2, further comprising terminating a current flowing to the cathode when a difference between the first voltage and the second voltage exceeds a threshold voltage level characteristic of the traveling-wave tube.

8. The method of claim 2, further comprising terminating a current flowing to the cathode when the first voltage exceeds a first threshold voltage level and the second voltage exceeds a second threshold voltage level.

9. The method of claim 2, further comprising controlling the second voltage with a circuit element in the switching module to prevent the second voltage from exceeding the first voltage by more than a predetermined amount when the current path is disabled.

10. A circuit comprising:

a switching module coupled to at least one power supply for supplying an operating current to a cathode, the operating current including a biasing current to establish a current path between the cathode and a beam focusing electrode, wherein the current path is disabled when the biasing current is below a predetermined level, the at least one power supply comprising:

a) a first power supply to establish a first electric potential between the cathode and an anode; and b) a second power supply to establish a second electric potential between the cathode and the beam focusing electrode, wherein energy stored at the cathode is prevented from discharging into a slow-wave structure of a traveling-wave tube when the current path is disabled.

11. The circuit of claim 10, wherein the second power supply stops providing current to the beam focusing electrode in response to the current path being disabled.

12. The circuit of claim 11, wherein the cathode operating current terminates in response to the current path being disabled.

13. The circuit of claim 10, wherein the cathode operating current is terminated when a difference between the first voltage and the second voltage exceeds a threshold voltage level.

14. The circuit of claim 10, wherein the traveling-wave tube cathode current is terminated when the first voltage exceeds a first threshold voltage level and the second voltage exceeds a second threshold voltage level.

15. The circuit of claim 10, wherein the power supply is a high-frequency switch mode or resonant power supply.

* * * * *